United States Patent [19]

Bolliger et al.

[11] 4,171,230

[45] Oct. 16, 1979

[54] TRANSFER MEDIUM WHICH IS SUITABLE FOR HEAT TRANSFER PRINTING ON ALUMINUM

[75] Inventors: Max Bolliger, Kreuzlingen; Harald Severus-Laubenfeld, Schaffhausen, both of Switzerland

[73] Assignee: Swiss Aluminium Ltd., Chippis, Switzerland

[21] Appl. No.: 936,222

[22] Filed: Aug. 24, 1978

[30] Foreign Application Priority Data

Sep. 9, 1977 [CH] Switzerland ..... 11039/77

[51] Int. Cl.[2] ..... C25D 11/18; C23F 5/04

[52] U.S. Cl. ..... 148/6.1; 8/2.5 A; 204/35 N; 427/146; 427/248 B; 428/914; 427/248 H

[58] Field of Search ..... 427/146; 8/2.5 A; 204/35 N, 38 A; 428/211, 914, 207; 148/6.1

[56] References Cited

U.S. PATENT DOCUMENTS

| | | | |
|---|---|---|---|
| 3,484,342 | 12/1969 | Blake et al. | 204/35 N X |
| 3,647,503 | 3/1972 | Mizutani et al. | 8/2.5 A |
| 3,888,623 | 6/1975 | Clarke et al. | 8/2.5 A X |
| 3,966,396 | 6/1976 | Howes et al. | 8/2.5 A |

OTHER PUBLICATIONS

Vellins, British Knitting Ind. vol. 45 #515 Apr. 1972 pp. 65, 67, 69, 70.

*Primary Examiner*—Ralph S. Kendall
*Attorney, Agent, or Firm*—Robert H. Bachman

[57] ABSTRACT

A transfer medium, made, for example, of paper, is imprinted with sublimable dispersion colorants by half-tone printing methods, and is suitable for sublimation heat transfer printing on non-sealed anodized aluminum via the trichromatic principle. The three basic colors used for this purpose are yellow, magenta and cyan. The transfer half lives of these basic colors at 200° C. lie between 3 and 10 seconds, and the specific weight of each of the basic colorants differs from that of the average of the combined colorants by not more than 10%.

9 Claims, 1 Drawing Figure yellow magenta

55% 45% cyan

TRANSFER MEDIUM WHICH IS SUITABLE FOR HEAT TRANSFER PRINTING ON ALUMINUM

BACKGROUND OF THE INVENTION

The invention concerns a transfer medium, in particular one made of paper, which has been printed on using sublimable dispersion colors by the halftone process, and which is suitable for sublimation heat transfer printing on anodized aluminum. The invention also concerns a process for carrying out the heat transfer printing.

Aluminum and aluminum based alloys in the form of finished or semi-finished products are anodized to provide them with superior corrosion and wear resistance and to give them a decorative appearance.

The article or semi-finished product is immersed in an electrolyte, generally comprising dilute sulphuric acid, occasionally with oxalic acid added. Less often, the electrolyte comprises only dilute oxalic acid dilute phosphoric or dilute chromic acid.

An oxide layer thus builds up on the surface of the item, which becomes the anode, under the influence of an electrical current. The current mainly takes the form of direct current (DC), less often using alternating current (AC) or by alternating between or overlapping AC and DC currents.

These oxide layers comprise in general a very thin, almost pore-free dielectric base layer, i.e., the so-called barrier layer, and a finely porous layer on top of the barrier layer. The barrier layer is self-regenerative, converting aluminum to aluminum oxide at the same rate as the top layer is produced by anodic oxidation.

The top layer is made up of bundles of fibers, oriented essentially perpendicular to the surface of the metal. The fibers are approximately 350 A in diameter and have a pore in the center approximately 150 A in diameter which reaches down to the barrier layer.

The finely porous top layer, formed using dilute sulphuric acid as the electrolyte and using direct current, is generally transparent and colorless.

There are many processes which can be employed to color this top oxide layer on anodized aluminum. These processes fall into four groups, depending on the way they produced the color effect.

1. By means of special electrolytes, e.g., aqueous solutions of carbonic acids or sulphonic acids.
2. By depositing metals in the pores in the bundles of fibers which make up the top layer of a transparent, colorless oxide layer by the application of alternating current in an aqueous solution of metallic salts.
3. By depositing inorganic pigments or organic coloring agents in the pores in the bundles of fibers which make up the top layer of a transparent, colorless anodic oxide layer by immersion in warm solutions containing the coloring agents.
4. By depositing organic coloring substances in the pores in the bundles of fibers which make up the top layer of a transparent, colorless anodic oxide layer such that sublimable, hydrolysis resistant colorants are printed on a transfer medium such as paper. The colorants are then drawn into the pores in the bundle of fibers in the absorbant top oxide layer on coming into contact with that layer and with the assistance of heat.

After the color transfer has occurred by depositing the colorant in the pores in the bundle of fibers which make up the oxide layer, this porous layer is closed or sealed by treatment in hot, deionized water or steam. As a result of this sealing process, at least a part of the $Al_2O_3$ in the newly formed oxide layer transforms to AlOOH, or pseudo-boehmite.

On examining the four different processes for coloring anodized aluminum, it becomes clear that multi-colored, patterned or image bearing oxide layers can be produced particularly advantageously at a commercially acceptable cost by using the fourth of the above processes. In this process, sublimable colorants can be transferred from a transfer medium, made, for example, of paper, plastic or metal foil, with the aid of heat and contact pressure, by so called heat transfer pressure.

This process has been known for some time now (see, for example, the German Patent DT-OS No. 15 21 849), but has not been able to develop into a process with widespread application. The reason for this is that the said process suffers from the serious disadvantage that the colorant or mixture of colorants on the transfer medium, such as paper, do not allow images which are true to color to be produced on anodized aluminum by means of conventional processes such as photogravure, litho, relief and screen printing.

The following factors caused the changes in color with respect to the original:

(a) On printing the transfer medium, such as the paper, by means of conventional printing methods, in particular by the offset printing method, coloring agents with different specific weights are transferred non-uniformly. As far as transfer printing using the trichromatic principle is concerned, such a result is a great disadvantage. The sublimable dispersion colorants normally employed have different chemical structures and can have very different specific weights.

(b) The amount of colorant sublimated as a function of time at constant temperature can, in the case of the conventional sublimable colorants, vary considerably. This variation causes the fine pores in the oxide layer to be filled mainly with the coloring agent which is transferred fastest or to the greatest extent at the given temperature, i.e., sublimized from the transfer medium and taken up by the pores.

(c) On sealing the pores by treatment in hot deionized water or steam after the color transfer stage, a portion of colorants at the surface of the oxide layer is washed away before the pores are closed by the formation of aluminum hydroxides.

When equal amounts of the various colorants have been sublimated or transferred, this effect, which removes excess colorant, is of no importance. When different amounts of colorants are transferred, due to different rates of sublimation at constant temperature, the washing off of colorant during sealing removes a large amount of the colorant which was transferred last and therefore lies next to the surface of the oxide. Color mixtures employed for coloring on the trichromatic principle then produce an undesirable shift in color tone, and the resultant image differs in color from the original.

The German patent mentioned above also reveals that this process can be carried out using coloring agents from the range of conventional sublimable dispersion colorants used in the textile industry. These agents include:

(a) Dispersion colorants based on anthrachinon, where either $H^-$, $OH^-$, or amino or amido groups with at least one active hydrogen atom, occupy at least one position 1, 4, 5 or 8;

(b) Azo colorants with an $OH^-$ group in the ortho position; or (c) Colorants with a 1, 3 indandion group.

The processes which represent the present state of the art of transferring images to non-anodized aluminum permit the production of patterns made up of areas of the same color where, for example, continuous changes in color tone or so called halftones are not possible. Only in special cases, therefore, can this process produce actual "pictures" on anodized aluminum.

The main disadvantage of the known processes can be seen to be that the printer who produces the transfer medium, for example, by offset, relief or photogravure printing or by some other suitable printing process, is forced to check the coloring on the product he makes, i.e., the transfer medium. In other words, the printer determines if the pattern corresponds in color with that on the printed transfer medium.

The present state of the art overcomes this disadvantage by using a suitable colorant or mixture of colorants for each color. However, on using known processes, even this improvement limits the number of colors which anodized aluminum can take to the range of sublimable colorants.

SUMMARY OF THE INVENTION

The inventors therefore have produced a transfer medium which allows non-sealed anodized aluminum to be colored to any color used in halftone printing. Thus, any kind of colored pattern can be produced in a simple manner in such oxide layers via the sublimation heat transfer printing method.

The invention achieves this objective in that any suitable printing method using the trichromate principle with the three basic colors yellow, magenta and cyan produces the colors on the transfer medium. In this process, the sublimation half life of the three basic colors at 200° C. is between 3 and 10 seconds, and the specific weight of each of the three basic colors differs from the average specific weight of the combined coloring agents by at most 10%.

The three basic colors used, yellow, magenta and cyan, which correspond or lie close to the "European scale" normally used in the printing industry to characterize colors, allow all tones of colors to be achieved by means of the trichromatic principle.

The sublimation half life of the colorant used in the process of the invention lies preferably between 4 and 8 seconds at 200° C.

The FIGURE illustrates colorants useful in the invention.

DETAILED DESCRIPTION

Figure 1:
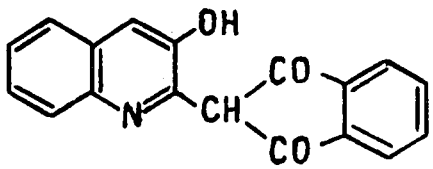
Figure 1:
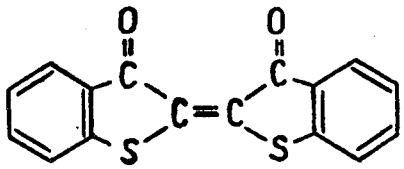
Figure 1:
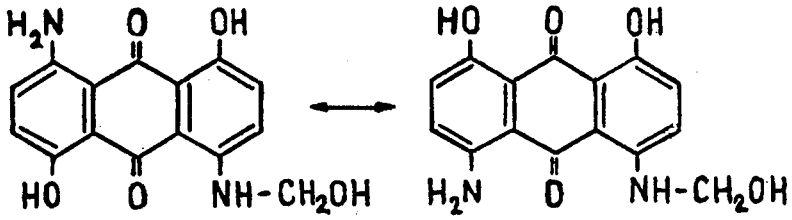

Extensive plant trials showed surprisingly that the sublimation half lives required by the invention represents a specific characteristic for each colorant from the range of sublimable colorants which are used in textile technology and which can also be employed to print on aluminum oxide layers via the sublimation transfer process.

The narrow range of transfer half lives of the three basic colors ensures that the ratio of these basic colors, i.e., yellow-magenta-cyan, remains essentially constant throughout the whole process of printing on aluminum. Thus, the specific ratio of the three basic colors for a color on the transfer medium, in the vapor phase and sublimated in the pores in the aluminum oxide layer, remains approximately unchanged. The following groups of substances have proven extremely advantageous in use as the three basic colors:

(a) yellow: quinophthalone derivatives (b) magenta: thioindigo or thioindigo derivatives (c) cyan: anthrachinon derivatives.

The following function describes sublimation behavior of such coloring agents, at least in a medium temperature range of approximately 120° C. to 220° C.

$$c_T = c_0(1 - e^{-kt})$$

where, $c_T$ = the % of colorant transferred by sublimation $c_0$ = the % of sublimable colorant on the transfer medium.

Since, in practice, only relatively expensive and time consuming methods allow absolute determination of these values, the percentage colorant sublimated after 60 seconds can be used instead.

k = sublimation rate constant—specific to the substance concerned ($s^{-1}$)

t = time in seconds

Because of the very small pore volume in such oxide layers, the ability of the oxide layer to absorb the colorant is very small. Clearly then, small differences in the sublimation behavior of the three coloring substances, as assured by the half life values required by the invention, result in only a very small displacement in the ratio of quantities due to the sublimation process. Thus, the differences lead to only a small change in color tone. Since the pore volume in the oxide layer is so small, the quantities of colorant to be deposited on the transfer medium cannot be chosen in terms of this volume. Instead, only the colorant's performance in preparing the transfer medium image determines the choice of quantity.

During sealing, hot or boiling water, in which heavy metal salts or other additives can be dissolved, washes off the excess colorant transferred by the sublimation process. In most cases, this colorant exhibits greater color changes than the colorant in the pores in the oxide because of the displacement in the ratio of quantities.

In accordance with the process of the present invention, the coloring substance further requires that the specific weight of the individual basic colorants deviates at most by 10% from their common, averaged specific weight. This requirement ensures optimum performance of the colorant on printing the transfer medium. This requirement also applies to the ease of transfer of the colorants.

All known printing processes can be used to prepare, i.e., print, the transfer medium. Offset printing processes are preferred. In terms of the present invention, paper is preferred as the transfer medium, specifically paper which can withstand temperatures of up to 240° C. and does not react or reacts only slightly with the colorant printed on it at such a high temperature. It is possible, however, in terms of the present invention to use a heat resistant plastic foil or sheet or metal foil or sheet as the transfer medium.

The colors can be printed on the transfer medium by normal printing methods. In this respect, the following binding agents have been found to be particularly favorable for the colorants:

(a) Colorants drying by oxidation: modified, air drying alkyd resin and modified colophonic resin; and for (b) Physically drying colorants: polyvinyl-acetates colophonium maleic resins colophonium acrylic resins Thus, the color deposited on the transfer medium may contain a binding agent which dries by oxidation and is selected from the group consisting of modified alkyl resins; and modified colophonic resins. Alternatively, the color deposited on the transfer medium may contain a physically drying binding agent selected from the group consisting of polyvinyl-acetate; colophonium maleic resins; and colophonium acrylic resins.

Oxide layers formed on aluminum or aluminum alloys by anodizing using direct current and dilute sulphuric acid electrolyte are particularly suitable for the absorption of colorants which can be sublimated.

The temperature range 160°-210° C. and a transfer time of 20 to 120 seconds, in particular about 60 seconds, have proven particularly suitable for heat transfer sublimation with the transfer medium of the present invention. In addition, the transfer medium may be used for more than only one printing, if it is provided with sufficient colorant. Such use, however, requires exact control of the heat transfer printing time.

The following examples serve to illustrate the present invention.

EXAMPLE I

FIG. 1 lists the chemical formulae of the dispersion colorants used here, corresponding to the three basic colors yellow, magenta and cyan. Pycnometric specific weight determinations of the colorants in water showed that the measured values for the three individual colorants did not vary by more than 6% from the average of the combined colorants. The transfer half lives of the three colorants were found to be 3.5 sec (yellow), 6.0 sec (blue) and 7.8 sec (red).

The three printing colorants were prepared by mixing the following components:

| | Wt. % |
|---|---|
| Dispersion colorants | 19 |
| Offset varnish (commercially available) | 50 |
| Hydrated aluminum oxide | 10 |
| Wax paste | 5 |
| Cobalt linoleate | 2.5 |
| Mineral oil | rest |

A test grid was prepared on paper by offset printing using the trichromatic principle.

After subsequent heat transfer printing on a non-sealed anodized aluminum sheet, which had been anodized at 190°±10° C. for 100 sec by the conventional DC, sulphuric acid process, no significant difference could be seen in color tone between that on the transfer medium and the colors on the anodized aluminum.

The aluminum oxide layer was then sealed in boiling water and no significant shift in color could be observed.

EXAMPLE II

The same procedure as in the previous example was employed here, except that the following substances were used for the basic colors yellow, magenta and cyan:

yellow: as in the first example magenta: CI solvent red 111, transfer half life 3 sec cyan: CI disperse blue 26, transfer half life 36 sec Specific weight measurements of the solvent red 111 and the disperse blue 26 showed that the values obtained differed from the average value obtained in the first example by about 10%. The transfer half life of the cyan colorant did not correspond to the value specified by the invention.

After sealing, comparison of the colors produced with the individual coloring agents yellow, blue and red to those on the transfer medium revealed no observable color shift. In the case of all color tones produced by mixing, however, there were pronounced shifts in color which make the process unusable.

These two examples demonstrate the significance of the properties required of the colorants by the present invention.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalancy are intended to be embraced therein.

What is claimed is:

1. A transfer medium imprinted with sublimable dispersion colorants by means of halftone printing methods, and suitable for sublimation heat transfer printing on non-sealed anodized aluminum, wherein the colors are deposited on the transfer medium by printing via the trichromatic principle using the three basic colors yellow, magenta and cyan and the transfer half lives of the three basic colors at 200° C. are between 3 and 10 seconds, and the specific weight of each of the three basic colorants differs from that of the average of the combined colorants by not more than 10%, wherein said range of transfer half lives of said basic colors ensures that the ratio of said colors remains essentially constant throughout the printing process and wherein said specific weight requirement of said basic colors ensures optimum performance of the colorant on printing the transfer medium and ease of transfer of colorants.

2. A transfer medium according to claim 1 wherein said medium is made of paper which can withstand temperatures of up to 240° C.

3. A transfer medium according to claim 1 wherein the transfer half life of the three basic colors lies between 4 and 8 seconds.

4. A transfer medium according to claim 1 wherein coloring agents from the quinophthalone derivative group are employed for the basic color "yellow".

5. A transfer medium according to claim 1 wherein thioindigo or thioindigo derivatives are employed for the basic color "magenta".

6. A transfer medium according to claim 1 wherein anthrachinon derivatives are employed for the basic color "cyan".

7. A transfer medium according to claim 1 wherein the color deposited on the transfer medium contains a binding agent which dries by oxidation and is selected from the group consisting of: modified alkyd resins; and modified colophonic resins.

8. A transfer medium according to claim 1 wherein the color deposited on the transfer medium contains a physically drying binding agent selected from the group consisting of: polyvinyl-acetate; colophonium maleic resins; and colophonium acrylic resins.

9. A process for printing on non-sealed anodized aluminum or aluminum alloys by means of sublimation head transfer printing, wherein the color is transferred from a transfer medium into the pores of said aluminum or aluminum alloys, wherein the colors are produced by the trichromatic principle using the basic colors yellow, magenta and cyan, and the sublimation half life of the individual colorants at 200° C. lies between 3 and 10 seconds, and the specific weight of each of the three basic colors deviates at most from that of their combined average value by a maximum of 10%, and the sublimation transfer is carried out at a temperature of 160° to 210° C. in a transfer time of 20 to 120 seconds.

* * * * *

UNITED STATES PATENT AND TRADEMARK OFFICE

CERTIFICATE OF CORRECTION

PATENT NO. : 4,171,230

DATED : October 16, 1979

INVENTOR(S) : Max Bolliger and Harald Severus-Laubenfeld

It is certified that error appears in the above-identified patent and that said Letters Patent are hereby corrected as shown below:

In Column 1, line 35, change "A" to read ---Å---.

In Column 1, line 36, change "A" to read ---Å---.

In Column 3, lines 57-58, change "represents" to read ---represent---.

In Column 7, line 5, claim 9, change "head" to read ---heat---.

Signed and Sealed this

*Twenty-second* Day of *January 1980*

[SEAL]

*Attest:*

SIDNEY A. DIAMOND

*Attesting Officer*

*Commissioner of Patents and Trademarks*